United States Patent [19]

Goldstein

[11] Patent Number: 4,646,761

[45] Date of Patent: Mar. 3, 1987

[54] CIGARETTE FILTER HOLDER

[75] Inventor: Jerome J. Goldstein, Denver, Colo.

[73] Assignee: Aquafilter Corporation, Fort Lauderdale, Fla.

[21] Appl. No.: 725,901

[22] Filed: Apr. 22, 1985

[51] Int. Cl.[4] ..... A24D 3/04; A24D 3/06

[52] U.S. Cl. ..... 131/335; 131/173; 131/200; 131/201; 131/337

[58] Field of Search ..... 131/178, 228, 173, 335, 131/200, 201

[56] References Cited

U.S. PATENT DOCUMENTS 3,375,920 4/1968 Shaw ..... 131/335

4,003,387 1/1977 Goldstein ..... 131/338

*Primary Examiner*—V. Millin

[57] ABSTRACT

A disposable cigarette holder-filter includes a cigarette receiving socket end and a mouthpiece end. The interior of the holder includes a fibrous filtering material impregnated with water. The mouthpiece end of the holder is formed with an integrally formed diaphragm and removable plug, which upon removal provides an opening into the interior of the cigarette filter. The diaphragm allows for compact size and a recessed opening. The plug is adapted for easy removal.

8 Claims, 4 Drawing Figures

CIGARETTE FILTER HOLDER

BACKGROUND OF THE INVENTION

This invention relates to an improvement in cigarette filtering devices and particularly those devices which are prepackaged with water-impregnated fibrous material. More specifically, the present invention is designed to provide certain improvements over the filter structure illustrated and described in U.S. Pat. No. 4,003,387. The cigarette filters described in that patent provided a simplified integrally formed means for sealing the mouthpiece ends comprising an integrally molded plug that is removed by twisting it from the main body of the end piece. Such a construction simplified the manufacturing process and use of the filter.

While the disposable cigarette holder described in U.S. Pat. No. 4,003,387 is functional, certain features have some limitations. First, the filter described in that patent is relatively long and therefore uses more raw materials than is necessary, both in manufacturing and in packaging. Because of its length it is aesthetically unacceptable to some people. Second, rough edges may at times be formed when the plug is removed which may come in contact with and irritate the mouth of the user. Third, both hands are ordinarily required to remove the plug in the intended manner: one to hold the filter and one to twist the wings of the plug. Finally, the wings of the plug project sufficiently so that they may accidentally catch some object and inadvertently tear loose.

SUMMARY OF THE INVENTION

The present invention resides in providing an improved cigarette filter holder in which the mouthpiece end of the filter holder is substantially shortened by providing a diaphragm integrally molded with and extending normally from the sidewalls of the holder just posterior to the filter, in which said diaphragm is recessed by extending the sidewalls of the holder beyond the plane of the diaphragm, and in which the plug is provided with a fingernail grip enabling the plug to be removed by a finger or thumb on the same hand holding the disposable filter.

Thus, it is an object of the present invention to provide a compact disposable cigarette filter holder that uses less raw materials for production and packaging.

It is further an object of the present invention to provide a compact disposable cigarette filter holder in which the diameter and shape of the mouthpiece end are substantially the same as the diameter and shape of the cigarette-receiving end so that the holder appears continuous with a cigarette and relatively unnoticeable when in use.

It is further an object of the present invention to provide a disposable cigarette filter holder with a mouthpiece end having a plug with a recessed fracture line thus preventing the mouth of the user from contacting the rough edges of the fracture line.

It is further an object of the present invention to provide a disposable cigarette filter holder with a plug that is removable with only one hand.

DESCRIPTION OF THE DRAWINGS

The foregoing and other objects and advantages of this invention will be understood more fully from the following detailed description of a preferred embodiment of the invention, with specific references to the accompanying drawings, in which.

DESCRIPTION OF THE PREFERRED EMBODIMENT

Figure 1:
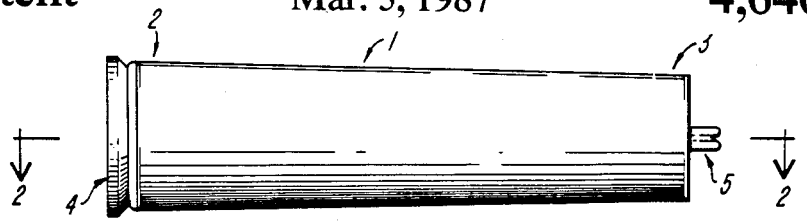
FIG. 1 is a plan view of a cigarette filter of the type described, embodying the invention.

FIG. 1 illustrates a preferred embodiment of the present invention. In particular the preferred embodiment is a disposable cigarette filter holder in which the filtering material comprises a fibrous material pre-impregnated with water. In general this type of cigarette filter holder has been described in U.S. Pat. Nos. 3,137,303, 3,379,920, 3,797,644, 4,003,387, and 4,201,232. The filter includes a casing 1, formed from a suitable plastic material. The casing 1 has annular cigarette receiving end 2 which tapers gently to a mouth-inserting end 3 at the other end.

The cigarette receiving end 2 is provided with a cylindrical metal sleeve 21 constructed as described in U.S. Pat. No. 4,003,387. The cylindrical metal sleeve 21 is fitted firmly into the cigarette receiving end 2 of the casing 1 with an outwardly extending flange 22 engaging the edge 23 of the casing. The edge 23 is smooth so that the appearance of the outer casing 1, the edge 23 and the flange 22 of sleeve 21 is that of a smooth cylinder similar to a cigarette. Metal sleeve 21 defines the cigarette receiving portion of socket 4 and is proportional to receive a cigarette in snug fit. The cigarette receiving portion of metal sleeve 21 is axially aligned and integral with a narrower diameter sleeve segment 21A. This sleeve segment 21A terminates at its inner end in an inwardly extending flange 30. A cylindrical filter 20 of water impregnated fibrous material is disposed and secured in the casing rearwardly of sleeve 21A between flange 30 and diaphragm 7.

The completed filter is sealed until use at the socket 4 by a cap 24 having an annular sidewall 25 which is closed at the bottom by an integral and continuous dome-like button 26. The outer edge of the sidewall 25 is outwardly and arcuately flared to define a lip 27. This lip 27 is spaced from the flange 22 on the sleeve 21 to define a recess 29 of sufficient dimension to permit one to insert a fingernail between these two lips for removal of cap 24. The cap is formed of a suitable substantially gas impervious plastic having sufficient flexibility and resilience to permit insertion and removal of the cap with relative ease.

Figure 2:
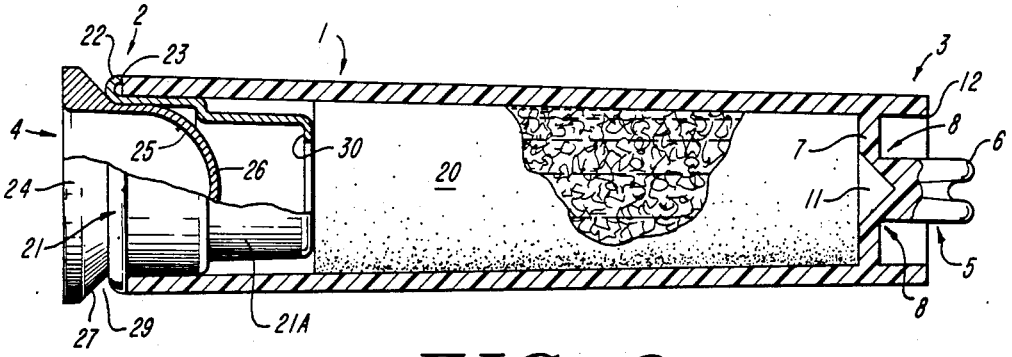
FIG. 2 is an illustration of the filter, in section, taken along the line 2—2 in FIG. 1.
Figure 3:
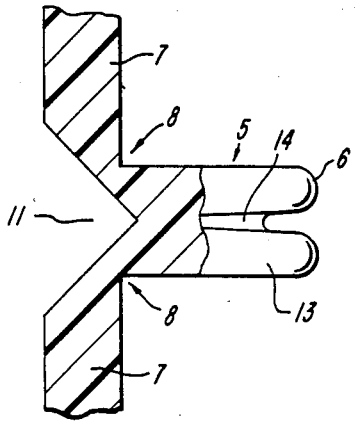
FIG. 3 is an enlarged fragmentary cross sectional detail of the diaphragm and plug of the mouthpiece end taken along the same lines as illustrated in FIG. 2.
Figure 4:
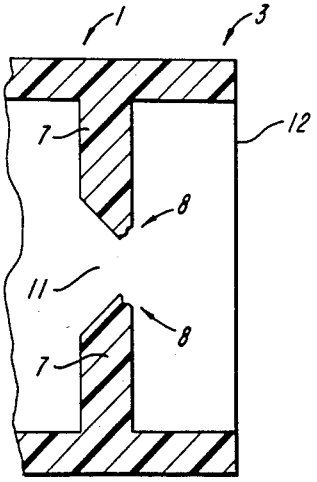
FIG. 4 is a view of the mouthpiece end similar to the view of FIG. 3, but with the plug removed.

As illustrated in FIGS. 2 and 3, the diaphragm 7 is integrally formed with the wall of the casing 1 and with a plug 5, which extends axially fron the diaphragm outwardly of the mouth-inserting end 3. A recess 11 formed in the diaphragm extends slightly into the base of plug 5. The annular segment at the junction of the diaphragm 7 and plug 5 has a thickness that is less than the thicknesses of the adjacent portion of the plug 5 and the diaphragm 7. This segment defines a fracture line 8 along which the plug 5 may be severed from the main portion of the integrally formed diaphragm 7 when the plug is pivoted from a position perpendicular to the diaphragm illustrated in FIG. 3. The recess 11 extends slightly beyond the plane in which the outer surface of diaphragm 7 lies. Thus, upon removal of the plug 5 along the fracture line 8, the recess 11 provides an opening through the mouth-inserting end of the filter.

The mouth-inserting end 3 of the casing 1 extends beyond the diaphragm 7 to an outer edge 12. Thus, the edges of the fracture line 8 are recessed slightly within the body of the casing 1 thereby protecting the tongue from a possible rough edge formed in the fracture line 8. The plug 5 extends axially from the diaphragm 7 beyond the outer edge 12 of the mouth-inserting end 3. The plug 5 preferably consists of elongated elements 13 with longitudinal grooves 14. These elements 13 end in separate knobs 6 that can be easily gripped by a fingernail.

The plugs may readily be severed from the diaphragm 7 by holding the casing 1 with the fingers of a hand and by engaging the knobs 6 with the thumbnail and pulling. This will cause the plug 5 to rupture from the diaphragm 7 along the fracture line 8 thereby opening the recess 11. Upon removal of the plug 5 and cap 24 the filter is ready for insertion of a cigarette and use.

In FIG., 4, the plug has been ruptured from the diaphragm 7 of the casing 1 along fracture line 8, thereby opening recess 11. The potentially rough edges of fracture line 8 are recessed from the outer edge 12 thereby protecting the tongue of the user.

It should be understood that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. In a disposable cigarette holder made of plastic, a mouthpiece end comprising:

an annular sidewall defining the mouthpiece end, a diaphragm integrally formed with said mouthpiece end, a removable plug integrally formed with said diaphragm and spaced from the sidewall, said diaphragm and said removable plug together closing said mouthpiece end, and said plug extending outwardly from said mouthpiece end and adapted upon flexing to separate from said diaphragm leaving an opening therethrough.

2. A disposable cigarette holder as set forth in claim 1 including means forming a recess in said diaphragm in axial alignment with said plug and with said recess extending through said diaphragm into the base of said plug.

3. A disposable cigarette holder as set forth in claim 2 wherein an annular segment at the junction of said diaphragm and plug has a thickness less than the adjacent portions of said diaphragm and plug thereby defining a fracture line.

4. A disposable cigarette holder as set forth in claim 3 wherein said diaphragm is inset from the mouthpiece end of the sidewall.

5. A disposable cigarette holder as set forth in claim 4 wherein said removable plug includes means for engaging a fingernail.

6. A disposable cigarette holder as set forth in claim 5 wherein said means consists of elongated elements with longitudinal grooves.

7. A disposable cigarette holder as set forth in claim 2 further comprising a casing having an opening at the other end shaped to receive the tip of a cigarette, a removable cap extending over said opening, said casing also having a passage extending from said opening to the mouthpiece end of the tubular member, a fluid containing member positioned in said passage.

8. A disposable cigarette holder as set forth in claim 7 wherein said casing tapers from a cigarette receiving end to the mouthpiece end.

* * * * *